US006213791B1

(12) United States Patent
Kodama

(10) Patent No.: US 6,213,791 B1
(45) Date of Patent: Apr. 10, 2001

(54) COUPLING DETECTING STRUCTURE OF LEVER COUPLING TYPE CONNECTOR

(75) Inventor: Shinji Kodama, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/140,539

(22) Filed: Aug. 26, 1998

(30) Foreign Application Priority Data

Aug. 29, 1997 (JP) ..... 9-234787

(51) Int. Cl.[7] ..... H01R 13/62
(52) U.S. Cl. ..... 439/157; 439/188
(58) Field of Search ..... 439/157, 310, 439/372, 489, 188, 911

(56) References Cited

U.S. PATENT DOCUMENTS 5,888,081 * 3/1999 Konoya et al. ..... 439/157
5,971,779 * 3/1999 Okabe ..... 439/157
5,993,226 * 11/1999 Yamaguchi ..... 439/157

FOREIGN PATENT DOCUMENTS 5-8882 2/1993 (JP) .

* cited by examiner

*Primary Examiner*—Khiem Nguyen
*Assistant Examiner*—Son V. Nguyen
(74) *Attorney, Agent, or Firm*—Finnegan, Henderson, Farabow, Garrett & Dunner, L.L.P.

(57) ABSTRACT

A coupling detecting structure includes: a first and a second connector housings accommodating terminals; a lever having an engaging portion engaging with an engaging portion of the second connector housing; and a detecting circuit detecting the coupling state of both of the connector housings. When the lever is revolved with respect to the engaging section between the engaging portion of the lever and the engaging portion of the second connector housing, both of the connector housings are coupled. In the construction, a pair of conductive members are provided on the second connector housing; a conductive member which comes into a contact with the pair of the conductive members only when both the connector housings are coupled with each other is provided on the lever; and the three conductive members constitute the detecting circuit.

11 Claims, 6 Drawing Sheets

COUPLING DETECTING STRUCTURE OF LEVER COUPLING TYPE CONNECTOR

BACKGROUND OF THE INVENTION

1. Field of the Invention

This invention relates to a lever coupling type connector in which female and male connector housings each having multiple poles are coupled with or uncoupled from each other by a small force by a revolution of a lever (action of lever) and more particularly to a coupling detecting structure of a lever coupling type connector, having a coupling detecting means and the like for confirming whether or not both the connector housings are completely coupled with each other.

2. Description of the Related Art

Japanese Utility Model Application Laid-Open No. 5-8882 has disclosed this kind of the coupling detecting structure of a lever coupling type connector. A lever coupling type connector for use in this coupling detecting structure comprises a synthetic resin male connector housing in which a pair of engaging pins are erected in the center of upper and lower faces thereof and a pair of connecting state detecting terminals are provided on a rear portion of both sides of the upper and lower faces, a synthetic resin female connector housing with which the male connector housing is to be coupled, a synthetic resin, U-shaped lever rotatably supported by the upper and lower faces of the female connector housing through each supporting shaft, a contact piece which is a conductive piece inserted in each slit on both side portions of the lever and a connector connection detecting circuit connected to the pair of the connecting state detecting terminals through lead wire.

Furthermore, an arc-shaped eccentric cam groove in which each engaging pin is to be inserted is formed around each supporting shaft on both the side portions of the lever. The U-shaped contacting piece made of conductive material is inserted in each slit inside both the side portions of the lever. Both ends of this contacting piece are contact points.

Then, if each engaging pin of the male connector housing is inserted into each eccentric cam groove of the lever supported rotatably by the female connector housing and the lever is revolved toward the side of the male connector housing, each engaging pin of the male connector housing is moved along each eccentric cam groove of the lever, so that the male connector housing and female connector housing each having multiple poles are coupled with each other. When both the connector housings are coupled with each other, each contact points of the U-shaped contacting piece provided between both the side portions of the lever comes into contact with each contact point of a pair of the connecting state detecting terminals . By this contact, a connector connection detecting circuit is actuated turning on a light emitting diode or dispatching a connection complete detection signal so as to inform that both the connector housings are completely coupled with each other.

However, because in the aforementioned conventional lever coupling type connector, the U-shaped contacting piece is installed to each slit of both the side portions of the lever, the coupling of both the connector housings cannot be confirmed steadily because the contacting piece is often loose off the connecting state detecting terminal. Further, because the connecting state detecting terminal, the metallic conductive contacting piece and components of the connector connection detecting circuit are indispensable to confirm the coupling of both the connector housings the number of the necessary parts increases so that production cost also increases. Further, because such a special circuit wire as lead wire for connecting the connecting state detecting terminal with the connector connection detecting circuit is necessary, the production cost increases correspondingly.

SUMMARY OF THE INVENTION

The present invention has been achieved with such points in mind.

It therefore is an object of the present invention to provide a coupling detecting structure of a lever coupling type connector capable of confirming a coupling state between female and male connector housings easily and securely at a low cost.

To achieve the object, according to a first aspect of the present invention, there is provided a coupling detecting structure of a lever coupling type connector, comprising: a first connector housing accommodating terminal; a second connector housing accommodating terminal, the second connector housing having an engaging portion; a lever having an engaging portion engaging with the engaging portion of the second connector housing, the lever being rotatably supported through supporting shafts by the first connector housing, the lever being revolved with respect to the engaging section between the engaging portion of the lever and the engaging portion of the second connector housing as a fulcrum point so that both of the connector housings are capable of being freely coupled with each other; and a detecting circuit detecting the coupling state of both of the connector housings, wherein a pair of conductive members are provided on the second connector housing; a conductive member which comes into a contact with the pair of the conductive members only when both the connector housings are coupled with each other is provided on the lever; and the pair of conductive members and the conductive member provided on the lever constitute a part of the detecting circuit.

In this coupling detecting structure of the lever coupling type connector, the conventional connecting state detecting terminal, metallic conductive contacting piece and components of the connector connection detecting circuit are not necessary, so that the number of the necessary parts decreases correspondingly. Further, there hardly occurs a looseness between the conductive members so that the coupling state of both the connector housings can be carried out always stably at a low cost.

Furthermore, the construction of the coupling detecting structure of a lever coupling type connector according to the present invention can be simplified, so that the cost thereof can be also reduced.

According to a second aspect of the invention, as it depends from the first aspect, the coupling detecting structure of a lever coupling type connector, further comprising: a printed circuit board; and a plurality of the second connector housings are disposed and fixed on the printed circuit board through a pair of conductive members, wherein the pair of the conductive members of each of the second connector housings are connected in series through circuit patterns on the printed circuit board and the conductive member of the lever, and a coupling detecting means for detecting a coupling state of both of the connector housings is provided on the detecting circuit in which the circuit patterns and the conductive members are disposed in series.

In this coupling detecting structure of the lever coupling type connector, because the detecting circuit is disposed on the circuit pattern on the printed circuit board, production cost is lower than the conventional type using wire. By disposing the circuit patterns on the printed circuit board and respective conductive members in series, it is possible to detect couplings of plural connectors with a single coupling detecting means. Therefore, the cost of the construction of the coupling detecting structure of a lever coupling type connector according to the present invention can be further reduced.

According to a third aspect of the invention, as it depends from the first aspect, further comprising: a printed circuit board; and a plurality of the second connector housings are disposed and fixed on the printed circuit board through a pair of conductive members, wherein at least one of the pair of the conductive members of each of the second connector housings is connected in series through a circuit pattern provided on the printed circuit board between the printed circuit board and each of the second connector housings and the conductive member of the lever; and a coupling detecting means for detecting a coupling state of both of the connector housings is provided on the detecting circuit in which the circuit patterns and the conductive members are disposed in series.

In this coupling detecting structure of the lever coupling type connector, in addition to the effect of the second aspect, a space of the printed circuit board is effectively used, so that no special wire is needed for plural connectors thereby correspondingly achieving simplification of the structure and lower cost.

According to a fourth aspect of the invention, as it depends from the second or the third aspect, the pair of conductive members of the second connector housing are constituted of metallic pieces for fixing the second connector housing to the printed circuit board.

In this coupling detecting structure of the lever coupling type connector, because the metallic pieces for fixing the other connector housing to the printed circuit board are used as conductive members at the same time, the number of the necessary parts decreases correspondingly so that a further simplification of the structure and lower cost can be achieved.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
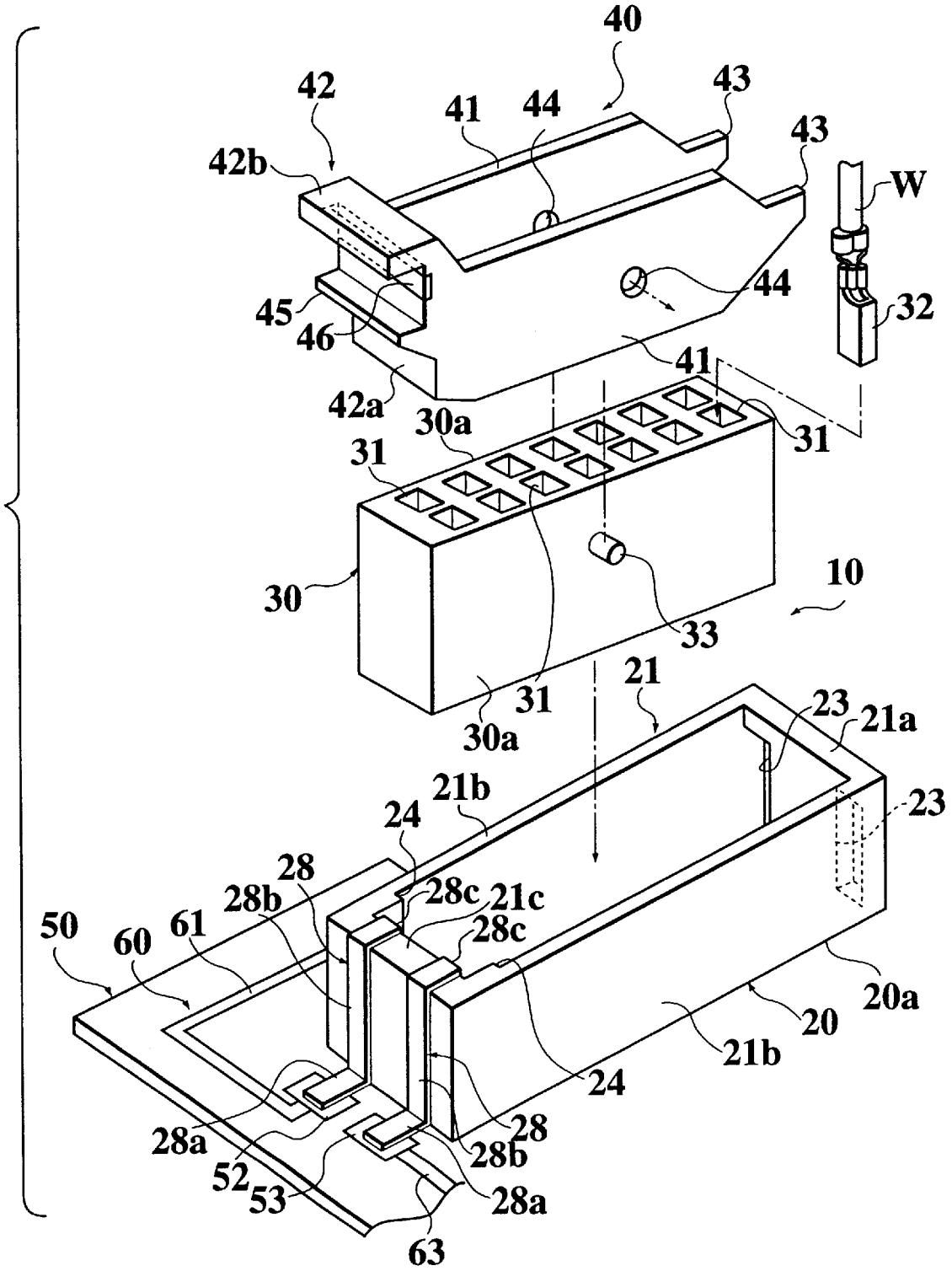
FIG. 1 is an exploded perspective view showing a coupling detecting structure of a lever coupling type connector according to an embodiment of the present invention.

There will be detailed below the preferred embodiments of the present invention with reference to the accompanying drawings. Like members are designated by like reference characters.

Figure 2:
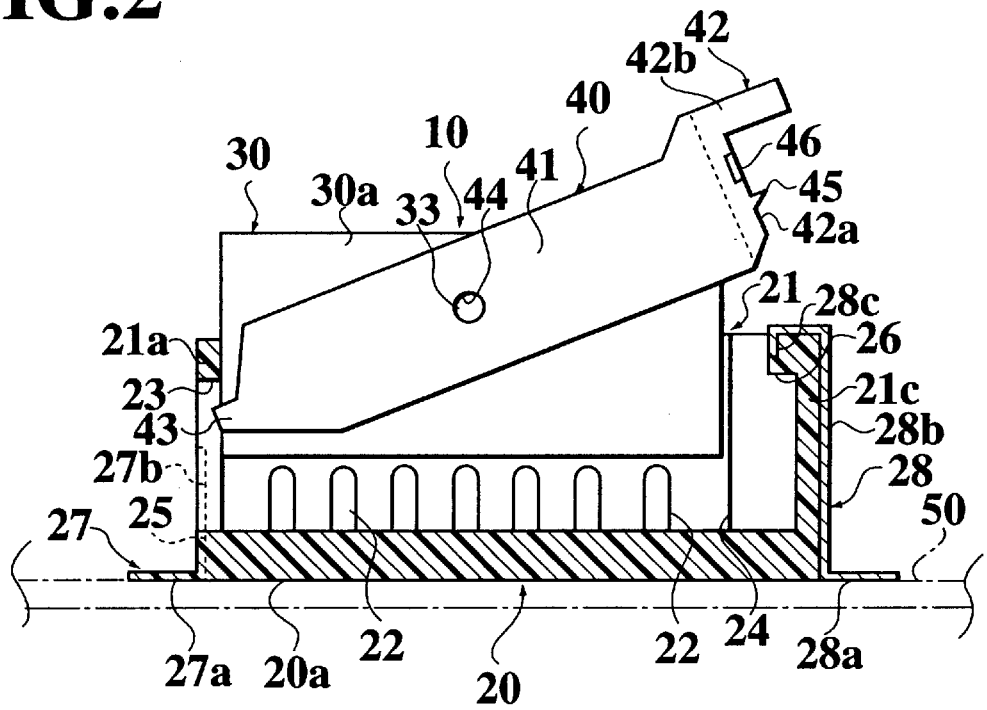
FIG. 2 is a sectional view showing a state prior to coupling of the lever coupling type connector for use in the coupling detecting structure.
Figure 3:
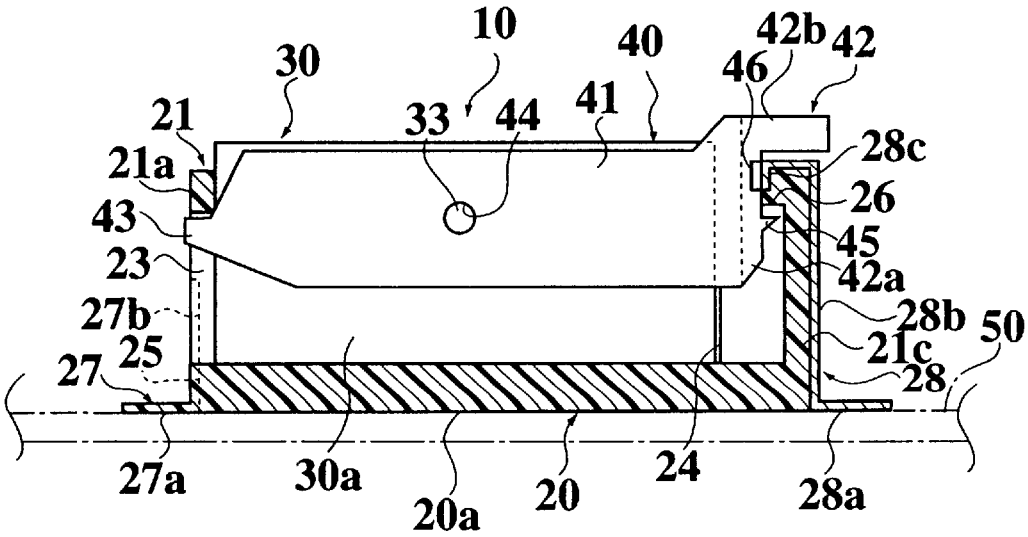
FIG. 3 is a sectional view showing a complete coupling state of the lever coupling type connector.
Figure 4:
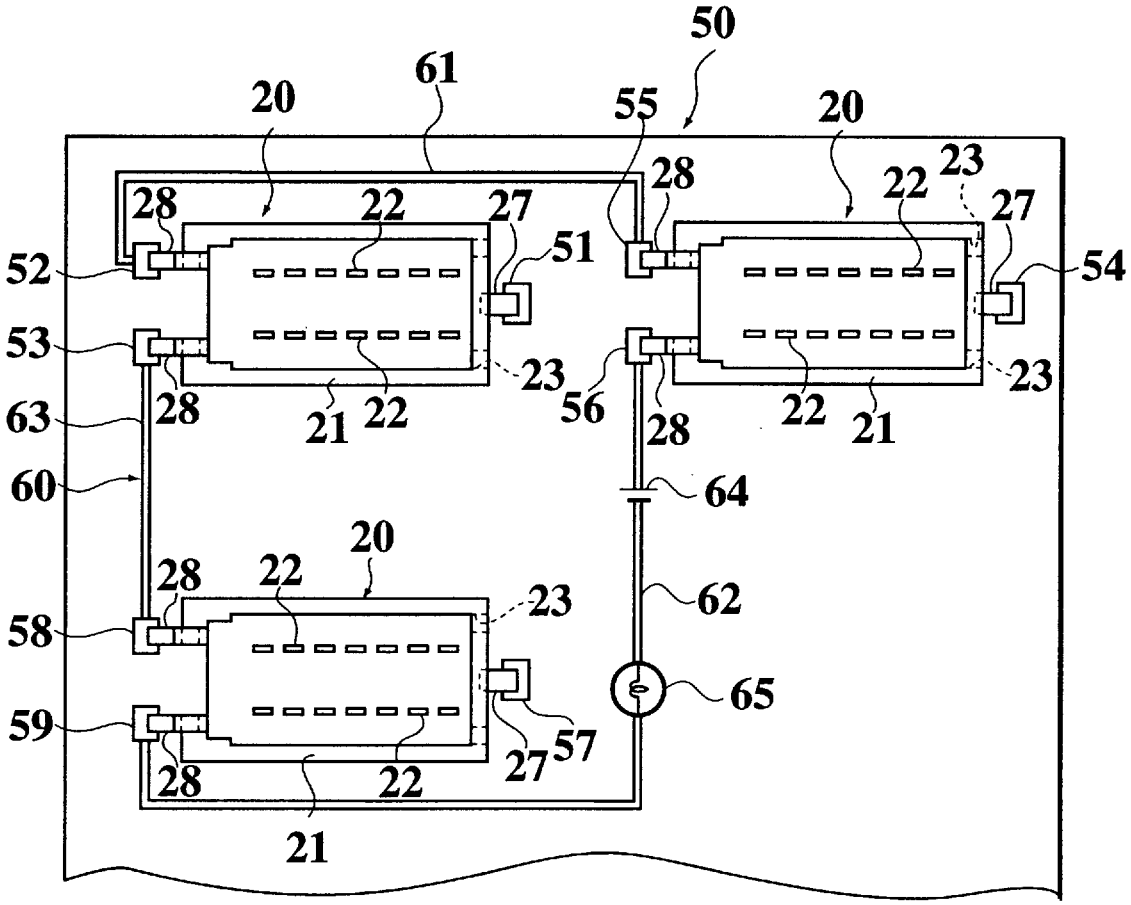
FIG. 4 is a plan view showing a state in which female connector housings of plural lever coupling type connectors are mounted on a printed circuit board.
Figure 5A:
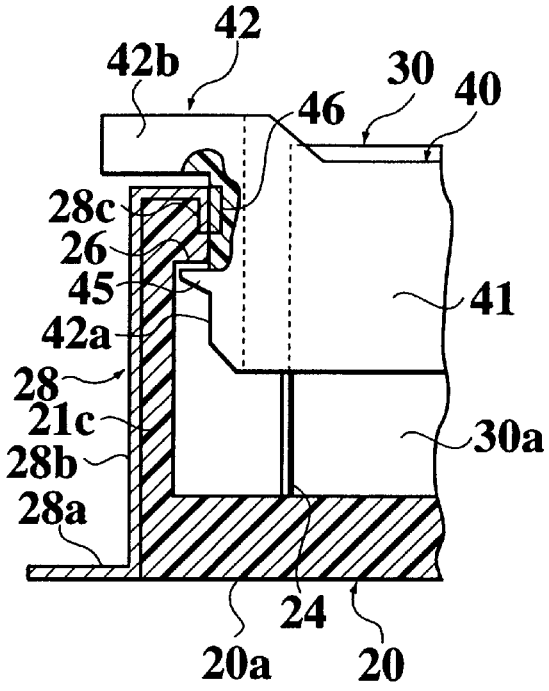
FIG. 5A is an enlarged sectional view of major parts of the lever coupling type connector and FIG.5B is an enlarged sectional view of the same major parts of other embodiment.
Figure 5B:
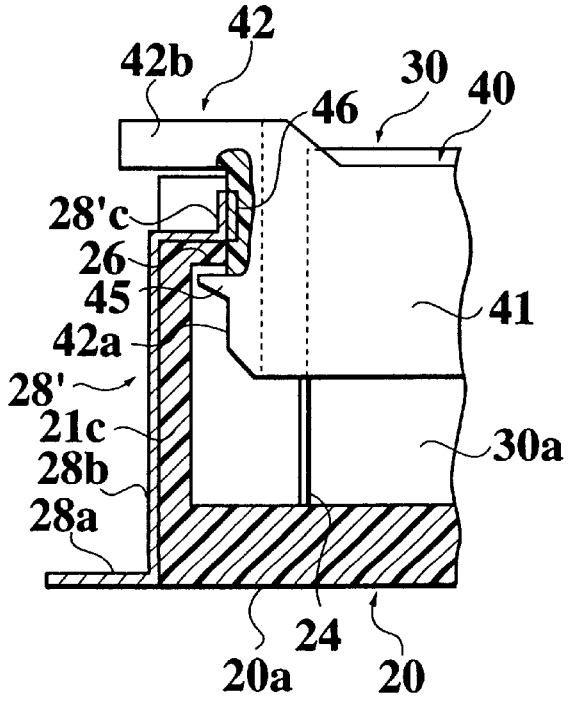

FIG. 1 is an exploded perspective view showing a coupling detecting structure of a lever coupling type connector according to an embodiment of the present invention. FIG. 2 is a sectional view showing a state prior to the coupling of the lever coupling type connector for use in the same coupling detecting structure. FIG. 3 is a sectional view showing a complete coupling state of the same lever coupling type connector. FIG. 4 is a plan view showing a state in which a plurality of female connector housings of the same lever coupling type connector are mounted on a printed circuit board. FIG. 5A is an enlarged sectional view of major parts of the same lever coupling type connector and FIG. 5B is an enlarged sectional view of the same major parts according to other embodiment.

As shown in FIGS. 1–4, a lever coupling type connector 10 comprises a synthetic resin female connector housing (a housing) 20 in which a plurality of male terminals 22 are erected within a hood portion 21 formed integrally therewith so as to protrude upward and a pair of engaging holes (engaging portion) 23, 23 are formed in a front wall 21*a* of the hood portion 21, a synthetic resin male connector housing (the other connector housing) 30 having a plurality of terminal accommodating chambers 31 for accommodating a plurality of female terminals 32 and which is inserted into the hood portion 21 along a pair of guide convex portions 24, 24 of the hood portion 21 of the female connector housing 20, and a synthetic resin lever 40 having a substantially U-letter shape on plan view, which is supported rotatably by supporting shafts 33, 33 formed integrally with the male connector housing 30 in substantially center of each of both side faces 30*a*, 30*a* thereof so as to protrude while each of protrusions (engaging portion) at ends can be freely fit into or released from each of a pair of the engaging holes 23, 23 of the female connector housing 20, and which couples/uncouples both the connector housings 20, 30 when it revolves with respect to an engagement section between the protrusion 43 and engaging hole 23 serving as a fulcrum. A plurality (e.g., 3 in case shown in FIG. 4) of the lever coupling type connectors 10 are disposed and mounted on a printed substrate 50 such as a printed circuit board.

As shown in FIGS. 1–4, the hood portion 21 of the female connector housing 20 is provided with a bottom portion and a rectangular cylindrical portion having an open top end. A pair of rectangular engaging holes (engaging portion) 23, 23 are formed on both sides of a lower portion of the front wall (a wall) 21*a* of the hood portion 21. Further, a pair of the guide convex portions 24, 24 are formed integrally of the hood portion 21 so as to protrude on a rear portion of each inside face of both side walls 21*b*, 21*b* of the hood portion 21. A concave portion 25 is formed in the center of an outside face of the front wall 21*a* of the hood portion 21 and a stepped lock receiving portion (lock engaging portion) 26 is formed on an upper portion of the inside face of a rear wall (the other wall) 21*c* of the hood portion 21. An L-shaped metallic piece 27 for fixing the printed circuit board is fixed in the concave portion 25 of the front wall 21*a* of the hood portion 21 via a predetermined means such as adhesive agent and a pair of metallic pieces (conductive members) 28, 28 for fixing the printed circuit board are fixed to a portion stretching from the outside face of the rear wall 21*c* of the hood portion 21 to the lock receiving portion 26 with a predetermined means such as adhesive agent.

As shown in FIGS. 2, 3, the metallic piece 27 is L-shaped, having a horizontal portion 27*a* and a horizontal portion 27*b*. The horizontal portion 27*a* is flush with a bottom face 20*a* of the female connector housing 20 and soldered to respective rectangular pads (soldering portion) 51, 54, 57 of the printed circuit board 50. The vertical portion 27*b* is fitted in the concave portion 25 in the front wall 21*a* of the hood portion 21 and fixed via a predetermined means such as adhesive agent. The metallic piece 28 has a rectangular sheet like horizontal portion 28*a* and vertical portion 28*b* bent from the horizontal portion 28*a*, an end portion 28*c* of the vertical portion 28*b* being further bent in a U shape. This horizontal portion 28*a* is mesh with a bottom face 20*a* of the female connector housing 20 and soldered to respective rectangular pads (soldering portion) 52, 55, 58 or 53, 56, 59 of the printed circuit board 50. As shown in FIG. 5(*a*), the vertical portion 28*b* is fixed to the rear wall 21*c* of the hood portion 21 via a predetermined means such as adhesive agent and the end portion 28*c* extends in the vicinity of the lock receiving portion 26 of the rear 21*c* of the hood portion 21 and is fixed to a top end of the rear wall 21*c* via a predetermined means such as adhesive agent.

Although the metallic pieces 27, 28 are fixed with adhesive agent or the like, they may be embedded in the hood portion 21 through insert-molding. In this case, as shown in FIG. 5(*b*), an end portion 28*c*' of each metallic piece (conductive member) 28' is formed in an L-shape and penetrated into the upper portion of the rear wall 21*c* of the hood portion 21 such that the end portion 28*c*' is located at a middle portion of the inside face.

As shown in FIG. 1, each terminal accommodating chamber 31 of the male connector housing 30 penetrates from a top thereof to a bottom and accommodates each terminal 32 to which an end of wire W which is a wire harness bundle is connected by crimping. Further, substantially in the center of both side faces 30*a*, 30*a* of the male connector housing 30 are formed cylindrical supporting shafts 33 integrally therewith such that they protrude vertically with respect to each of the side faces 30*a*.

As shown in FIGS. 1–3, the lever 40 is formed in a U shape on a plan view, having both side pieces 41, 41 and an operation piece 42 formed on each of proximal ends thereof integrally therewith. The protrusions 43, 43 of both the side pieces 41, 41 can be fitted to or released from a pair of the engaging holes 23, 23 of the female connector housing 20. Substantially in the center of each of both the side pieces 41, 41 of the lever 40 is formed a circular engaging hole 44 in which each supporting shaft 33 erected on both the side faces 30*a*, 30*a* of the male connector housing 30 is to be fit. Further, the operation piece 42 of the lever 40 comprises a wall portion 42*a* formed on proximal ends of both the side pieces 41, 41 integrally therewith and an operation portion 42*b* having a L-shaped section, formed on a top end of the wall portion 42*a* integrally therewith. Substantially in the center of an outside face of the wall portion 42*a* of the operation piece 42 is formed a flexible locking piece (locking means) 45 having a substantially triangular section such that it protrudes horizontally. The locking piece 45 engages with the lock receiving portion 26 of the female connector housing 20 when both the female and male connector housings 20, 30 are coupled with each other.

A rectangular sheet like metallic piece (conductive portion) 46 is buried by insert-molding in parallel to the locking piece 45 at a position opposing the end portions 28*c*, 28*c* of a pair of the metallic pieces 28, 28 between the operation portion 42*b* and locking piece 45 of the wall portion 42*a* of the operation piece 42. The metallic piece 46 of this lever 40 comes into a contact with the end portions 28*c*, 28*c* of the pair of the metallic pieces 28, 28 of the female connector 20 only when both the female and male connector housings 20, 30 are coupled with each other. These metallic pieces 28, 28, 46 form a part of a detecting circuit 60 for detecting the coupling state of the female and male connector housings 20, 30.

As shown in FIG.4, each metallic piece 27 of three female connector housings 20, 20, 20 is fixed to each of the pads 51, 54, 57 of the printed circuit board 50 by soldering. Further, one metallic piece 28 (upper one in FIG. 4) of each of the three female connector housings 20, 20, 20 is fixed to each of the pads 52, 55, 58 of the printed circuit board 50 by soldering while the other metallic piece 28 (lower one in FIG. 4) is also fixed to each of the pads 53, 56, 59 of the printed circuit board 50 by soldering. The pad 52 and pad 55 are connected to each other by a circuit pattern 61 for coupling confirmation on the printed circuit board 50, the pad 56 and pad 59 are connected to each other by a circuit pattern 62 for coupling confirmation on the printed circuit board 50, and the pad 53 and pad 58 are connected to each other by a circuit pattern 63 for coupling confirmation on the printed circuit board. Consequently, the respective circuit patterns 61, 62, 63 on the printed circuit board 50 are connected in series through the pair of the metallic pieces 28, 28 of each female connector housing 20 and the metallic piece 46 of the lever 40. The circuit pattern 62 includes a power supply 64 like a battery and a light emitting diode (coupling detecting means) 65 for detecting the coupling state of both the female and male connector housings 20, 30. The detecting circuit 60 is constituted of the metallic pieces 28, 28, 46, pads 52, 55, 56, 59, 58, 53, circuit patterns 61, 62, 63, power supply 64, and light emitting diode 65.

According to the coupling detecting structure of the lever coupling type connector 10 of this embodiment, as shown in FIG. 2, each of the protrusions 43 of the lever 40 is inserted into each of the engaging holes 23 of the female connector housing 20 in such a condition that the lever 40 is supported by the supporting shafts 33 of the male connector housing 30 and then the operation portion 42*b* of the lever 40 is revolved downward with respect to the coupling portion between each of the protrusions 43 of the lever 40 and each of the engaging holes 23 of the female connector housing 20 as a fulcrum point. As a result, the male connector housing 30 is inserted into the hood portion 21 along a pair of the guide convex portions 24, 24 of the hood portion 21 of the female connector housing 20 and fitted therein. Then, if the male connector housing 30 is fitted into the hood portion 21 of the female connector housing 20, the locking piece 45 of the lever 40 engages with the lock receiving portion 26 of the hood portion 21 of the female connector housing 20. Consequently, the male connector housing 30 is completely fitted into the hood portion 21 of the female connector housing 20 so that both the connector housings 20, 30 are completely coupled with each other.

In this manner, as shown in FIG. 4, the male connector housings 30 are coupled with the female connector housings 20 successively. If the male connector housings 30 are coupled with all the female connector housings 20, as shown in FIGS. 3, 5A, the metallic piece 46 of the lever 40 securely, comes into an electrical contact with the end portions 28*c*, 28*c* of a pair of the metallic pieces 28, 28 of each female connector housing 20 without looseness, so that a complete coupling state of each of the pairs of the female and male connector housings 20, 30 can be detected simply by a lighting of the light emitting diode 65 of the detecting circuit 60.

When the female and male connector housings are uncoupled from each other, the operation portion 42*b* of the female connector housing 20 is revolved upward so as to release the coupling between the locking piece 45 of the lever 40 and lock receiving portion 26 of the hood portion 21 of the female connector housing 20, so that the male connector housing 30 is raised over the hood portion 21 of the female connector 20. Consequently, the male connector housing 30 can be uncoupled from the hood portion 21 of the female connector housing 20.

As described above, part of the detecting circuit 60 for detecting a coupling state between the female connector housing 20 and male connector housing 30 is constituted of a pair of the metallic pieces 28, 28 fixed to the rear wall 21*c* of the hood portion 21 of the female connector housing 20 and the metallic piece 46 buried in the wall portion 42*a* of the operation piece 42 of the lever 40 and which comes into a contact with the end portions 28*c*, 28*c* of the aforementioned pair of the metallic pieces 28, 28 only when both the connector housings 20, 30 are coupled with each other. Therefore, any connection state detecting terminal, metallic conductive contact piece or component for detection of the connector connection detecting circuit seen in a conventional art is not required, so that correspondingly, the number of components is reduced thereby achieving simplification of the structure and low production cost. Because when the female and male connector housings 20, 30 are coupled with each other, the rear wall 21*c* of the hood portion 21 of the female connector housing 20 is in contact with the wall portion 42*a* of the operation piece 42 of the lever 40, the end portions 28*c*, 28*c* of the pair of the metallic pieces 28, 28 securely come into a contact with the metallic piece 46 without looseness. Therefore, the coupling of the female and male connector housings 20, 30 can be always confirmed in a stable condition.

Further, because the circuit patterns 61, 62, 63 on the printed circuit board 50 are employed to constitute the detecting circuit 60, lower cost can be achieved as compared to a conventional case using wires. Further because the circuit patterns 61, 62, 63 on the printed circuit board 50, the metallic pieces 28, 46 and the like are disposed in series, it is possible to visually confirm couplings of a plurality of the connectors 10 by a lighting of the single light emitting diode 65. Further, the metallic piece 28 for fixing each female connector housing 20 to the printed circuit board 50 is used as a conductive member of the detecting circuit 60 at the same time, the number of the components can be reduced so that the coupling detecting structure can be further simplified and lower cost can be achieved.

Figure 6:
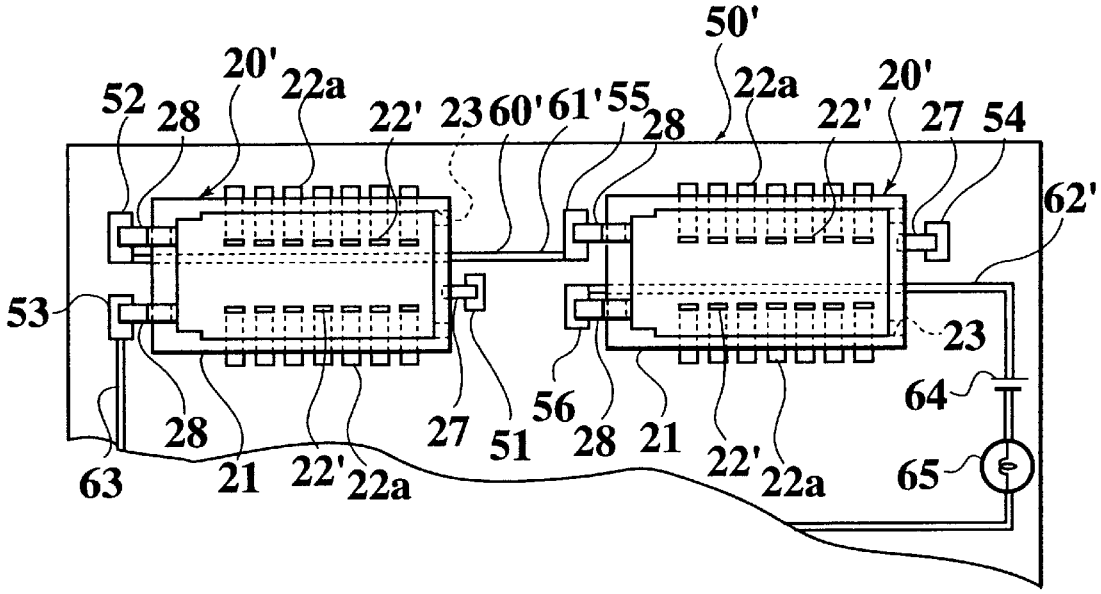
FIG. 6 is a plan view showing a state in which plural female connector housings having a coupling detecting structure of lever coupling type connector according to another embodiment of the present invention are mounted on the printed circuit board.

FIG. 6 is a plan view showing a state in which a plurality of female connector housings 20' having a coupling detecting structure of a lever coupling type connector according to another embodiment of the present invention are mounted on a printed circuit board 50'. Leg portions of plural male type terminals 22' of each female connector housing 20' protrude outwardly from a periphery of the hood portion 21 and each of the plural female connector housings 20' is disposed on the printed circuit board 50' through a pair of metallic pieces (conductive member) 28, 28. Then, one of pair of the metallic pieces 28, 28 of each female connector housing 20' is connected to the circuit patterns 61', 62' provided on the printed circuit board 50' between the printed circuit board 50' and bottom of the female connector housing 20' and the circuit pattern 63 in series through the same metallic piece (conductive member) 46 of the lever 40 of the male connector housing 30 as the previously described embodiment. A detecting circuit 60' in which the circuit patterns 61', 62', 63' and metallic pieces 28, 28, 46 are disposed in series has a light emitting diode (coupling detecting means) for detecting the coupling state of both the connector housings 20', 30'.

According to this embodiment, in addition to the previously described effect, because the circuit patterns 61', 62' constituting part of the detecting circuit 60' is disposed on the printed circuit board 50' just under the bottom of each female connector housing 20', which is a dead space loaded with the connector, the space of the printed circuit board 50' can be effectively used. Further, because no special wire is needed for plural connectors, the coupling detecting structure can be simplified and lower cost can be achieved.

Figure 7A:
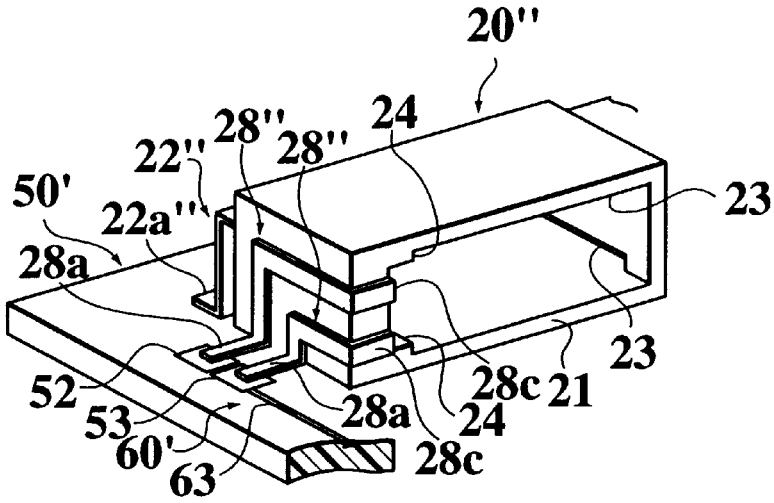
FIG. 7A is a perspective view showing a state in which a female connector housing having a coupling detecting structure of lever coupling type connector according to still another embodiment of the present invention is mounted on the printed circuit board.
Figure 7B:
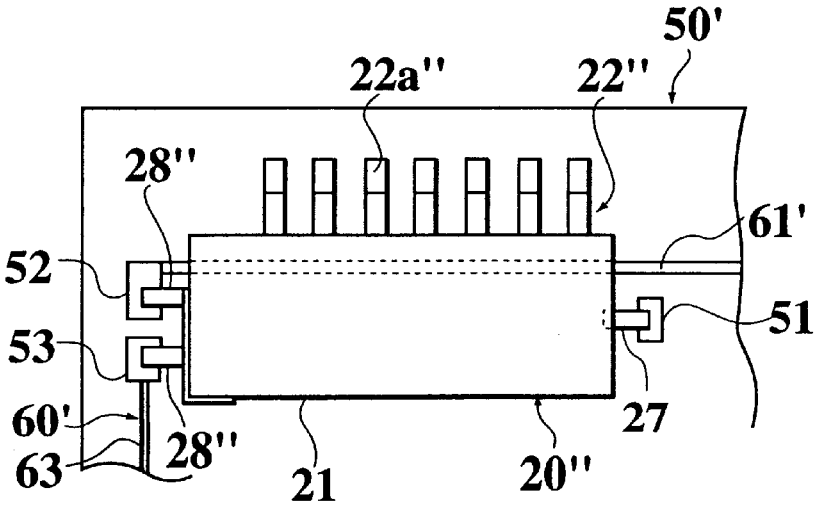
FIG. 7B is a plan view of the same state in FIG. 7A.

Although according to the above respective embodiments, the female connector housing is fixed on the printed circuit board in the vertical condition, as shown in FIGS. 7A and 7B, the female connector housing 20" may be fixed on the printed circuit board 50' in the horizontal condition. In this case also, the legs 22*a* of male type terminals 22" of the female connector housing 20" extend outside from the hood portion 21 and one of a pair of metallic pieces (conductive member) 28", 28" is connected in series through a circuit pattern 61" provided on the printed circuit board 50' between the printed circuit board 50' and bottom of female connector housing 20" and the like. Consequently, the same effect as the previously mentioned embodiments is achieved.

Although according to the above respective embodiments, the coupling state is confirmed by a lighting of the light emitting diode, it is permissible to confirm it by a turn-off of the light emitting diode when the coupling is achieved. Further, the coupling detecting means is not restricted to the light emitting diode, but it is needless to say that other confirming means such as a buzzer may be used. Although a case in which a plurality of the female connector housings are fixed on the same printed circuit board has been described, it is also needless to say that the present invention can be applied to a case in which a plurality of the printed circuit boards are used.

While preferred embodiments of the present invention have been described using specific terms, such description is for illustrative purposes, and it is to be understood that changes and variations may be made without departing from the spirit or scope of the following claims.

What is claimed is:

1. A coupling detecting structure of a lever coupling type connector, comprising:

a first connector housing accommodating terminal;

a second connector housing accommodating terminal, the second connector housing having an engaging portion in an end wall of the connector housing;

a lever having an engaging portion engaging with the engaging portion of the second connector housing, the lever rotatably supported by supporting shafts of the first connector housing, the lever being revolved with respect to an engaging section between the engaging portion of the lever and the engaging portion of the second connector housing as a fulcrum point so that both of the connector housings are capable of being freely coupled with each other; and a detecting circuit detecting the coupling state of both of the connector housings, wherein a pair of conductive members are provided on the second connector housing;

a conductive member which comes into contact with the pair of conductive members only when both the connector housings are coupled with each other is provided on the lever; and the pair of conductive members and the conductive member provided on the lever constitute part of the detecting circuit.

2. The coupling detecting structure of a lever coupling type connector according to claim 1, further comprising:

a printed circuit board; and a plurality of the second connector housings are disposed and fixed on the printed circuit board through a pair of conductive members, wherein the pair of the conductive members of each of the second connector housings are connected in series through circuit patterns on the printed circuit board and the conductive member of the lever, and a coupling detecting means for detecting a coupling state of both of the connector housings is provided on the detecting circuit in which the circuit patterns and the conductive members are disposed in series.

3. The coupling detecting structure of a lever coupling type connector according to claim 2, wherein the pair of conductive members of the second connector housing are constituted of metallic pieces for fixing the second connector housing to the printed circuit board.

4. The coupling detecting structure of a lever coupling type connector according to claim 1, further comprising:

a printed circuit board; and a plurality of the second connector housings are disposed and fixed on the printed circuit board through a pair of conductive members, wherein at least one of the pair of the conductive members of each of the second connector housings is connected in series through a circuit pattern provided on the printed circuit board between the printed circuit board and each of the second connector housings and the conductive member of the lever; and a coupling detecting means for detecting a coupling state of both of the connector housings is provided on the detecting circuit in which the circuit patterns and the conductive members are disposed in series.

5. The coupling detecting structure of a lever coupling type connector according to claim 4, wherein the pair of conductive members of the second connector housing are constituted of metallic pieces for fixing the second connector housing to the printed circuit board.

6. The coupling detecting structure of a lever coupling type connector according to claim 1, wherein the lever is "U" shaped, and the conductive member on the lever is positioned on a base portion of the "U" shape.

7. The coupling detecting structure of a lever coupling type connector according to claim 1, wherein the lever includes only a single conductive member.

8. The coupling detecting structure of a lever coupling type connector according to claim 1, wherein the lever includes a handle portion and a locking portion, and wherein the conductive member on the lever is located between the handle portion and the locking portion.

9. The coupling detecting structure of a lever coupling type connector according to claim 1, wherein, in a coupled state, the first connector housing is contained within the second connector housing.

10. The coupling detecting structure of a lever coupling type connector according to claim 1, wherein the first connector housing is a male connector housing and the second connector housing is a female connector housing.

11. A plurality of coupling detecting structures of a lever coupling type connector, the plurality of coupling detecting structures each being disposed and fixed on a printed circuit board through a pair of conductive members, wherein each coupling detecting structure comprises:

a first connector housing accommodating terminal;

a second connector housing accommodating terminal, the second connector housing having an engaging portion;

a lever having an engaging portion engaging with the engaging portion of the second connector housing, the lever rotatably supported by supporting shafts of the first connector housing, the lever being revolved with respect to an engaging section between the engaging portion of the lever and the engaging portion of the second connector housing as a fulcrum point so that both of the connector housings are capable of being freely coupled with each other; and a detecting circuit detecting the coupling state of both of the connector housings, wherein a pair of conductive members are provided on the second connector housing;

a conductive member which comes into contact with the pair of conductive members only when both the connector housings are coupled with each other is provided on the lever; and the pair of conductive members and the conductive member provided on the lever constitute part of the detecting circuit.

* * * * *